United States Patent [19]

Farler

[11] Patent Number: 4,978,130

[45] Date of Patent: Dec. 18, 1990

[54] DART FLIGHT ROTATION SHAFT AND FLIGHT ROTATION SHAFT ASSEMBLY

[76] Inventor: Charles W. Farler, 4503 Woodbine Ave., Dayton, Ohio 45420

[21] Appl. No.: 918,719

[22] Filed: Oct. 14, 1986

Related U.S. Application Data

[63] Continuation-in-part of Ser. No. 868,622, May 29, 1986, abandoned.

[51] Int. Cl.[5] ..... A63B 65/02

[52] U.S. Cl. ..... 273/423

[58] Field of Search ..... 273/423, 416, 419, 420; 403/165

[56] References Cited

U.S. PATENT DOCUMENTS

| | | | |
|---|---|---|---|
| 434,262 | 8/1890 | Freeman | 403/165 X |
| 913,056 | 2/1909 | Rounds | 403/165 X |

FOREIGN PATENT DOCUMENTS

| | | | |
|---|---|---|---|
| 835070 | 9/1938 | France | 273/416 |
| 445590 | 4/1936 | United Kingdom | 273/423 |
| 498823 | 1/1939 | United Kingdom | 273/423 |
| 534289 | 3/1941 | United Kingdom | 273/423 |
| 589208 | 6/1947 | United Kingdom | 273/423 |
| 684037 | 12/1952 | United Kingdom | 273/423 |
| 1370092 | 10/1974 | United Kingdom | 403/165 |
| 1508075 | 4/1978 | United Kingdom | 273/423 |
| 1516560 | 7/1978 | United Kingdom | 273/416 |
| 2064967 | 6/1981 | United Kingdom | 273/423 |

*Primary Examiner*—Paul E. Shapiro

*Attorney, Agent, or Firm*—Joseph Patrick Burke

[57] ABSTRACT

A dart flight rotation shaft and dart flight rotation shaft assembly. The dart flight rotation shaft is preferably, but not necessarily, integral and comprised of a cylindrical forward portion preferably, but not necessarily, uniform of substantially uniform diameter, and a flight mating portion having an outer diameter having one or more portion(s) of larger extension and/or smaller recess diameter than its remaining portion(s) to enable it to mate at such portion(s) in a slip-fit with one or more respectively smaller and/or larger inner diameter cavity portion(s) of a dart flight.

The dart flight rotation shaft assembly is comprised of the foregoing dart flight rotation shaft on which there is mounted a snap-on, rotatable flight comprised of a flight bushing tube located along the central axis of said flight, a plurality of vanes or fins equally spaced around said flight bushing tube and an axial cavity those inner diameter has a respective smaller and/or larger diameter portion(s) whose distance(s) and shape conform substantially to those respectively larger and/or smaller diameter portion(s) on the mating portion of said flight shaft to cause a slip-fit union therewith permitting said flight to rotate around said shaft. The flight rotation shaft and flight rotation shaft assembly are characterized in that no portion of said flight rotation shaft attachment is external to any external surface of said flight.

5 Claims, 3 Drawing Sheets

10
11
12
13
14
14'
15
16
17
19
20
23
24

DART FLIGHT ROTATION SHAFT AND FLIGHT ROTATION SHAFT ASSEMBLY

This application is a continuation-in-part of U.S. patent application Ser. No. 868,622 entitled "Dart Flight Rotation Shaft and Flight Rotation Shaft Assembly," filed on May 29, 1986 by the present inventor, now abandoned.

The present invention is directed to a dart flight rotation shaft and dart flight rotation shaft assembly. The dart flight rotation shaft is preferably but not necessarily integral and comprised of a cylindrical forward portion preferably but not necessarily of substantially uniform diameter, and a flight mating portion having an outer diameter having one or more portion(s) of larger (extension) and/or smaller (recess) diameter than its remaining portion(s) to enable it to mate at such portion(s) in a slip-fit with one or more respectively smaller and/or larger inner diameter cavity portion(s) of a dart flight. The expression "slip-fit" means that there is sufficient clearance between the outer diameter extension(s) and/or recess(es) of the shaft mating portion(s) and the corresponding respective recess(es) or extension(s) of the flight mating portion axial cavity to permit the flight to rotate on the shaft even though the flight and shaft are joined. The dart flight rotation shaft assembly is comprised of the foregoing dart flight rotation shaft on which there is mounted a snap-on, rotatable flight comprised of a flight bushing tube located along the central axis of said flight, a plurality of vanes or fins equally spaced around said flight bushing tube and an axial cavity whose inner diameter has a respective smaller and/or larger diameter [extension(s)] portion(s) whose distance(s) and shape conform substantially to those respectively larger and/or smaller diameter portion(s) on the mating portion of said flight shaft to cause a slip-fit union therewith permitting said flight to rotate around said shaft. The flight is thus free to rotate 360 degrees, clockwise or counter-clockwise, around said flight rotation shaft, said flight rotation shaft and flight rotation shaft assembly being characterized in that no portion of said flight rotation shaft means of attaching said flight thereto is external to any external surface of said flight.

The forward portion of the flight rotation shaft assembly is of substantially uniform diameter except that it may include a threaded front portion of sleek elongated dome exterior configuration suitable for threaded engagement with the mating threaded rearward portion of a dart body.

The diameters of the hub extension, and remaining mating portion of the flight rotation shaft are such that the flight is free to rotate around said assembly or be fixed thereon, depending on the positioning of the flight rotation shaft extension(s) and/or recess(es) in relation to the corresponding recess(es) or extension(s) of the axial cavity portion(s) of the flight.

The flight rotation shaft assembly of this invention is characterized in that it eliminates the requirement, common to prior art shaft assemblies for replaceable flights, or having flight attachment means external to the outer surfaces of the flight.

BACKGROUND OF THE INVENTION AND PRIOR ART

One of the problems causing dart bounce-out or fall-out occurs when a subsequently thrown dart strikes the flight and/or flight attachment means of a dart which is already stuck in the dart board, thereby stopping or deflecting the trajectory of said subsequent dart and reducing its momentum. This increases the probability that it will fail to hit the intended target or fail to stick in the dart board. If a bounce-out or fall-out occurs, then no score is produced. In addition, the following dart(s), by striking the flight of a prior thrown dart, may unseat the prior thrown dart from the dart board causing the loss of whatever score it has produced. To further complicate the problem, such occurrences are more apt to happen when the subsequently thrown dart(s) target is in close proximity to the previously thrown dart(s) already positioned on the dart board. When the limited area in question is a high point scoring area, the results can be very detrimental to the dart thrower and his team.

Many proposals have been made in the prior art to obviate the problems caused by protruding flight attachment means and fixed flights when struck by following darts.

U.S. Pat. No. 4,109,915 issued to Walter Edward Bottelsen is directed to a breakaway dart, viz., one whose flight shaft and flight fall away from the dart body when the dart strikes the dart board.

U.S. Pat. No. 4,138,113 issued to Walter M. Sheldon, Jr. teaches the use of a cluster of four pins having elliptical rounded heads in a flight assembly with the leading end of the pins secured in a hole in the dart fletching body and maintained in close tangential juxtaposition by means of a heat shrinkable tube which encases the leading end of said pins from the front end of the dart.

U.S. Pat. No. 4,487,420 issued to Martin G. Ollis, et al, is directed to a dart having a shaft to carry the flight with a slot opening diametrically through the thickness of the shaft so that the flight can be deformed to a flat condition and pushed laterally through the slot. The extreme end of the shaft behind the flight is closed and pointed or rounded to provide a deflection surface in the event of contact by a further (following) dart.

British Pat. No. 534,289 issued to Farrington, et al, discloses a dart whose flight does not rotate when thrown, but can rotate when struck by a following dart. Thus the flight of a dart adhering to a dart board is revolvable about the pin f so that the flight has the capacity to turn and so to "give" if struck by other darts. The Farrington et al dart is stated by the patentees to be not apt to become torn.

British Pat. No. 589,208 issued to Frederick Alfred Richardson, et al, teaches use of a dart whose flight vanes 8 rotate relative to serrated shaft 2 via rotatable hub 6 mounted on pin 7.

British Pat. No. 1,488,373 issued to Mary Louise Frost, et al, is directed to a dart deflector for attachment to a dart. The deflector is comprised of an elongate body having a plurality of slots extending longitudinally from one end thereof, each slot being arranged such as in use it can accommodate a wing of a dart flight. The other end of the body has a tapered portion and the deflector is attachable to the dart solely by means of an engagement between the flight of the dart and portions of said elongate body forming the sides of said slots. When so engaged, the deflector is located axially to the flight of the dart so that in use when the dart has pierced a dart board, the point of a following dart approaching said dart in an axial or a substantially axial direction is deflected by the tapered portion of said dart deflector away from said dart. The dart flight comprises two separate flight portions each of which has a single fold along the longitudinal axis thereof. A complete dart flight is formed by locating two such dart flight portions in the longitudinally extending slots in the shaft of the dart.

British Pat. No. 1,508,075 issued to Robert Perkins, et al, discloses a rotatable coaxial stud shaft for dart carrier fins (flight) and rotates on being struck by a following dart.

Published British Patent Application No. GB 2007989A by applicant/inventor, Albert Thomas Baker, is directed to end formation 15 for a dart flight 17 wherein said rear end formation forms an integral structure with a plurality of forwardly directed limbs 16. Rear end formation 15 is rearwardly tapered or pointed to deflect subsequently thrown darts.

Published British Patent Application No. GB 206 4967A of inventor Benjamin Charles Drake discloses a two part dart stem having a rear interfitting part 22 which carries the dart flight and is freely rotatable in relation to front part 20. Part 22 carries the flight and is a portion of the flight assembly which is secured to the metal barrel 12 via threaded bore 14.

BRIEF DESCRIPTION OF THE DRAWINGS

FIG. 11 illustrates a flight shaft with three recesses (12) combined with a flight having one extension (21) in the flight cavity.

FIG. 12 illustrates a flight shaft having one recess (12) and one extension (13) located near the shaft rearmost mating portion in combination with a flight having one extension (21) in combination with a recess (22) in its cavity.

In accordance with the present invention, it should be understood that one or more extension(s) can be provided on the flight rotation shaft with correspondingly shaped recesses of the same or different number on the flight cavity, or vice versa. Furthermore, combinations of a recess(es) and an extension(s) can be used in any desired position or location on the flight rotation shaft mating portion with corresponding extension(s) and recess(es) located in mating relationship and position on the flight cavity. Note FIGS. 1–6 in this regard. Moreover this(these) extension(s) can be of any desired shape, e.g., rounded, cylindrical, v-shaped, etc., and can be beveled, champfered, squared, etc. Also the forward portion of the shaft, viz., that portion not fitting within the flight cavity, can be of greater or lesser diameter than the shaft portion involved with mating, viz., the shaft portion within the flight cavity.

DETAILED DESCRIPTION OF THE INVENTION

Figures 1, 2, 3, 4:
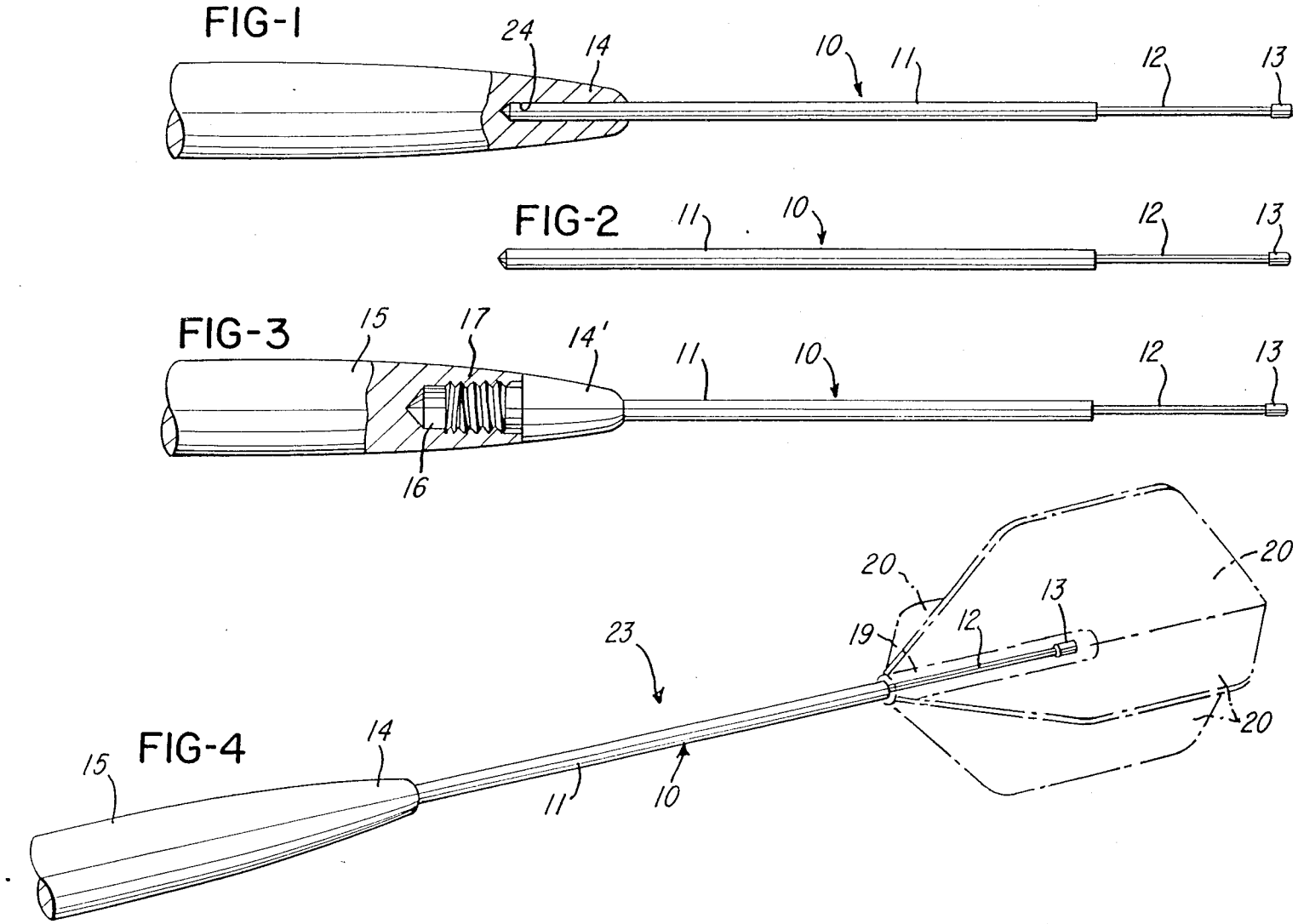
FIG. 1 is a fragmentary plan view with parts broken away and parts in section of the flight rotation shaft secured in place in a dart body.
FIG. 2 is a plan view of the flight rotation shaft of this invention apart from its environment of use.
FIG. 3 is a modification of the flight rotation shaft shown in FIG. 1 which provides a threaded front portion for attachment to a dart body rearward portion having mating threads.
FIG. 4 is a fragmentary perspective view of a flight rotation shaft assembly of this invention containing a flight rotation shaft as in FIGS. 1 or 3 with a snap-on flight (shown in phantom lines) mounted thereon.

As is illustrated in FIGS. 1–5, flight rotation shaft (10) is comprised (from front to back) of forward portion (11) having a diameter less than that of the rear portion (14) of dart body (17), but greater than both smaller diameter recess shaft portion (12) and rear hub extension portion (13) with 12 and 13 comprising the flight shaft mating portion. The forward portion (11) of flight rotation shaft (10) can be fixedly secured in a bore (24) in the rear end portion (14) of dart body (15) as shown in FIG. 1. Alternatively, flight rotation shaft (10) can be provided at its front end with an integral adapter portion (14') having a threaded front portion (16) which can be threaded into a mating threaded portion (17) in the dart body (15). In such a case, the shape of adapter portion (14') permits it to be the rear end portion of the dart body when in place in mating threaded portion (17). Portion (14) with threaded portion (16) can be made to be integral with the forward portion (11) of the flight rotation shaft. This is the embodiment illustrated in FIG. 3. Portions (14) and (14') are of sleek elongated dome exterior configuration and when integral with, or in place within, the dart body constitute the rear end thereof.

When the flight rotation shaft (10) of this invention is in place in a dart body (15), as in FIGS. 1, 3, 4 and 5, its front end (11) is secured to dart body (15) by press-fit, threaded engagement, adhesive, or equivalent means.

Figure 5:
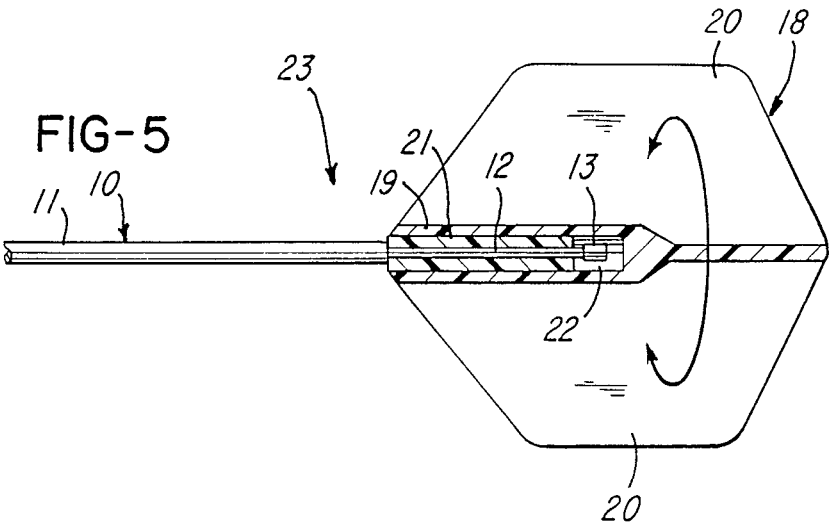
FIG. 5 is a fragmentary cross sectional view of the flight rotation shaft assembly with the flight rotation shaft and flight in position to rotate in either direction, e.g., upon being struck by a later thrown (following) dart.

The flight rotation shaft assembly (23) of this invention (FIG. 4) is comprised of the foregoing flight rotation shaft (10) on which flight (18) is mounted (FIG. 5).

Flight (18) is comprised (FIG. 6) of a flight bushing tube (19) located along the central axis of the flight, a plurality of vanes or fins (20) equally spaced around said flight bushing tube (19) and an axial cavity which can have a smaller inner diameter forward extension portion (22') communicating with a larger inner diameter rear recess portion (22), such axial cavity providing a gap or space between the inner surfaces of said cavity forward and rear portions so that upon insertion of said flight rotation shaft hub portion (13) through said front cavity extension portion (22') and into said rear cavity recess portion (22), said flight (18) is free to rotate 360 degrees, clockwise or counter-clockwise, around said flight rotation shaft. The flight rotation shaft assembly (23) is characterized in that no portion of flight rotation shaft [10 or the] means (13) of attaching flight (18) thereto is external to any external surface of flight (18).

As shown in FIG. 5, flight axial bore tube (21) can be inserted into flight bushing tube (19) as shown in FIG. 5, so that the internal surface of tube, viz., extension (21) defines the forward flight cavity axial portion (22').

As illustrated in FIG. 4 of the drawings, a plurality of flight fins or vanes (20), usually four, are equally spaced around flight bushing tube (19). Preferably said fins or vanes are formed integral with said flight bushing tube (19). Alternatively, fins or vanes (20) can be adhesively secured to said flight bushing tube. Preferably the vanes or fins and flight bushing tube are made of plastic.

Figure 6:
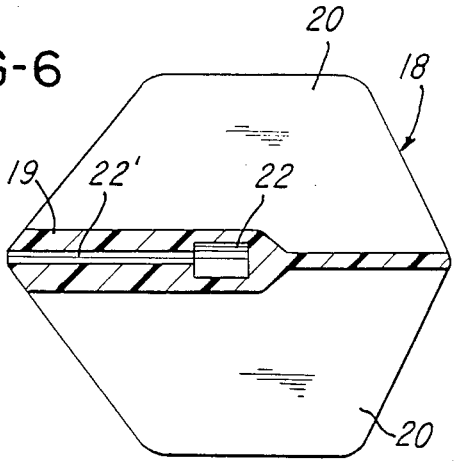
FIG. 6 is a cross-sectional view of the flight only wherein the interior axial bore (cavity) of the flight is formed, e.g., around an arbor or mandrel, so as to avoid the use of a flight axial bore tube shown in FIG. 5.
Figure 7:
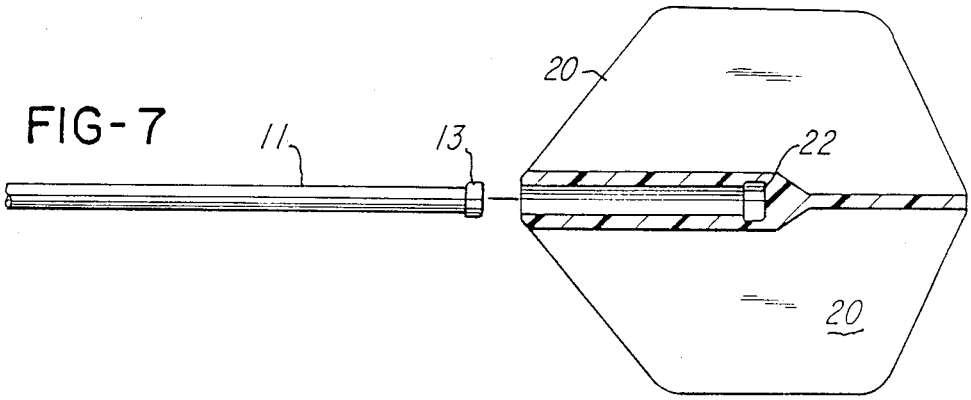
FIG. 7 is a fragmentary composite side and cross-sectional view of one embodiment of this invention illustrating a flight rotation shaft and flight prior to coupling (mating) having one cylindrical extension (13) on the shaft with one correspondingly shaped recess (22) in the cavity of the corresponding flight.
Figure 8:
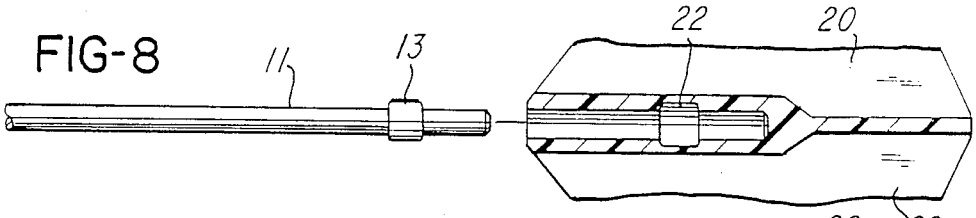
FIG. 8 is a fragmentary composite side and cross-sectional view of another embodiment of this invention similar to that of FIG. 7 and illustrating a single extension (13) on the flight rotation shaft which is wider than that shown in FIG. 7 with corresponding recess (22) on its flight.
Figure 9:
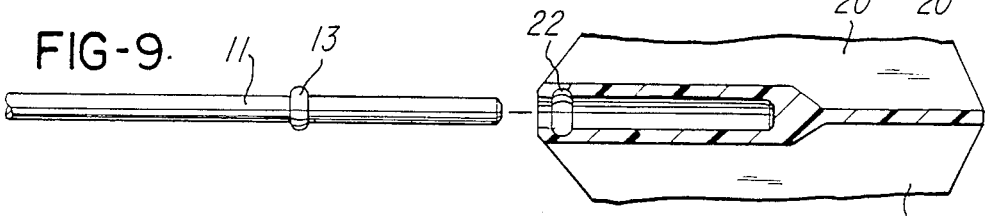
FIG. 9 is a view similar to those of FIGS. 7 and 8 but wherein the flight rotation shaft is provided with one or more substantially rounded extension(s) (13) with the flight cavity having a corresponding rounded recessed (22) surface(s). It will be observed that the number of recesses must be equal to or greater than the number of extensions.
Figure 10:
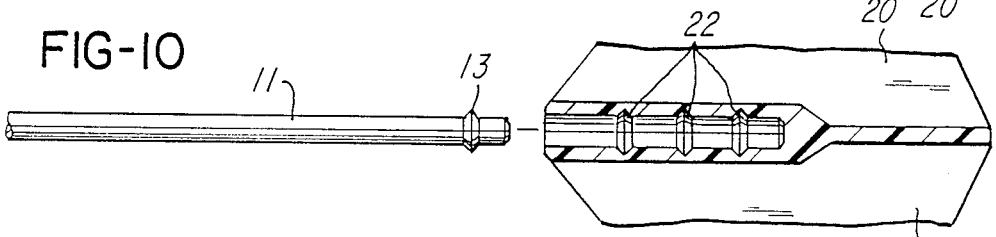
FIG. 10 is a view similar to those of FIGS. 7–9 but wherein the flight shaft extension or raised surface (13) is substantially v-shaped to accommodate one or more correspondingly shaped recesses of the flight cavity. This combination allows the shaft extension to mate in any one of three positions within the three recesses (22) of the flight cavity and allows the overall length of the dart to be varied at will.
Figure 11:
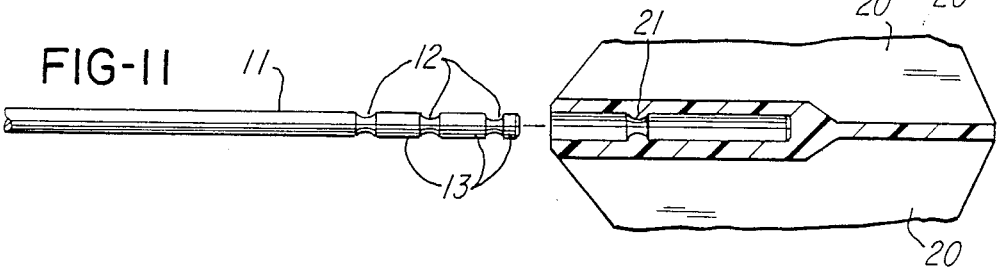
FIGS. 11–12 are views similar to FIGS. 7–10 but illustrate shaftflight combinations wherein the recesses are in the flight rotation shaft and the extensions (raised portions) are provided in the flight cavity.
Figure 12:
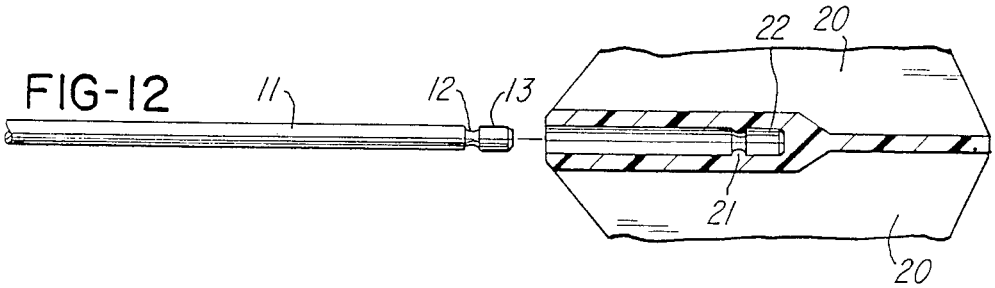

When there is a gap or space between the inner wall of flight bushing tube (19) and the rear hub portion (13) of flight rotation shaft (10), as in FIG. 6, the flight (18) is freely rotatable about its central axis 360 degrees in either direction. This is also true when such a gap or space exists between the inner wall of flight axial bore tube extension (21) and intermediate recess portion (12) of shaft (10) and larger cavity recess portion (22) and rear hub extension portion (13), as in FIG. 5. This illustrates one variation of the slip-fit feature previously mentioned.

However, when the forward portion (11) of the flight rotation shaft (10) is pushed so as to force a short length of said forward portion (11) into front cavity portion (22'), the friction between forward portion (11) of the flight rotation shaft and said front cavity portion (22') inhibits rotation of the flight. Thus it will be observed that in accordance with one embodiment of this invention the flight rotation shaft assembly (10) of this invention permits the flight to be freely rotatable or non-rotatable at the election of the user by simply making a slight manual adjustment in the position of shaft forward portion (11).

It is observed that the present flight rotation shaft assembly wherein the flight is freely rotatable helps to reduce greatly the possibility of a following dart striking the flight or attachment means therefor and producing a bounce-out. When the dart containing the flight rotation shaft assembly (23) of this invention is struck by a following dart, the likelihood that the following dart will be deflected is reduced significantly since the flight that is struck rotates out of the way regardless of the direction from which it is struck by the following dart. Moreover, the structural configuration of flight rotation shaft (10) is such that no portion of its means (13) of attachment to the dart flight (18) is external to any external surface of said flight, thereby presenting a minimal surface for deflection of a following dart. Moreover, when the flight rotation shaft (10) is employed with snap-on flight (18) to constitute flight rotation shaft assembly (23) in accordance with a preferred aspect of this invention, the present invention provides a means to readily attach and detach the snap-on dart flight (18) by the simple procedure of inserting the rear hub portion (13) of the flight rotation shaft (10) through cavity portion (22') and into the portion (22) of the axial cavity (bore) of the dart flight (18). As hub (13) passes into cavity portion (22), it produces a "snap" sound. This is the reason for the reference to "snap-on".

The dart body indicated herein as (15) in FIGS. 1, 3 and 4 preferably utilized in conjunction with the dart flight rotation shaft (10) and dart flight rotation shaft assembly (23) of this invention is that double action, recocking dart body disclosed and claimed in my co-pending patent application Ser. No. 868,621 entitled "Anti-Bounce-Out Dart" filed May 29, 1986. The entire disclosure of this patent application Ser. No. 868,621 is incorporated herein by reference as if repeated fully herein. Said application also claims said double action, recocking dart body in conjunction with the dart flight rotation shaft assembly (23) constituting one embodiment of this invention.

The dart flight embodiment indicated herein as (18) in FIGS. 4, 5 and 6 which can be used as the flight in flight rotation shaft assembly (23) of this invention is, per se, disclosed and claimed in may co-pending patent application Ser. No. 868,804 entitled "Snap-On Dart Flight" filed on May 29, 1986. The entire disclosure of this patent application Ser. No. 868,804 is incorporated herein by reference as if repeated fully herein.

I claim:

1. A dart shaft-flight assembly comprised of a non-rotating dart flight shaft and a rotatable snap on readily removable dart flight, having a central axis, attached thereto, said shaft having a cylindrical forward portion and a flight mating portion readily separable from said snap-on, readily removable, attached dart flight said dart flight further comprised of a flight bushing tube located along the central axis of said flight, a plurality of vanes or fins equally spaced around said flight bushing tube and an axial cavity whose inner diameter has one or more respective recess(es) and/or extension(s) whose distance(s) and shape conform substantially to respective extension(s) and/or recess(es) on a flight attachment means of said shaft flight mating portion yet leave a gap or a space therebetween permitting said flight to be free to rotate, clockwise or counter-clockwise, around such shaft; wherein said shaft flight mating portion has a means of attachment to said flight around which said flight can rotate freely, clockwise or counter-clockwise, said shaft attachment means having an outer diameter with one or more portions of larger, diameter (extension) and/or smaller diameter (recess) than its remaining portion(s) to enable it to mate at such extension(s) and/or recess(es); and wherein said shaft-flight assembly is characterized in that no portion of said shaft flight attachment means is external to any external surface of said flight.

2. A dart shaft-flight assembly as in claim 1 wherein said flight bushing tube contains a flight axial bore tube located in the forward portion thereof.

3. A dart shaft-flight assembly as in claim 1 wherein said vanes or fins are integral with said flight bushing tube.

4. A dart shaft-flight assembly as in claim 1 wherein said vanes or fins and said flight bushing tube are plastic.

5. A dart shaft-flight assembly as in claim 1 wherein said shaft forward portion is attached to a threaded front portion adapter for attachment to a dart body rearward portion having mating threads.

* * * * *